US011858669B2

(12) United States Patent
Sforacchi

(10) Patent No.: US 11,858,669 B2
(45) Date of Patent: Jan. 2, 2024

(54) DEVICE FOR APPLYING COVER SHEETS TO PALLETISED LOADS

(71) Applicant: E80 Group S.p.A., Viano (IT)

(72) Inventor: Gianluca Sforacchi, Viano (IT)

(73) Assignee: B80 GROUP S.P.A., Viano (IT)

( * ) Notice: Subject to any disclaimer, the term of this patent is extended or adjusted under 35 U.S.C. 154(b) by 941 days.

(21) Appl. No.: 16/635,003

(22) PCT Filed: Dec. 13, 2018

(86) PCT No.: PCT/IB2018/060025
§ 371 (c)(1),
(2) Date: Jan. 29, 2020

(87) PCT Pub. No.: WO2019/162751
PCT Pub. Date: Aug. 29, 2019

(65) Prior Publication Data

US 2020/0239168 A1 Jul. 30, 2020

(30) Foreign Application Priority Data

Feb. 22, 2018 (IT) ..... 102018000002957

(51) Int. Cl.
*B65B 11/58* (2006.01)
*B65B 11/02* (2006.01)
*B65B 61/22* (2006.01)

(52) U.S. Cl.
CPC ..... *B65B 11/585* (2013.01); *B65B 11/025* (2013.01); *B65B 61/22* (2013.01)

(58) Field of Classification Search
CPC ... B65B 11/585; B65B 11/025; B65B 11/045; B65B 61/22
(Continued)

(56) References Cited

U.S. PATENT DOCUMENTS 5,819,503 A 10/1998 Lancaster, III
6,584,752 B1 * 7/2003 Herava ..... B65B 11/585 53/399
8,538,579 B2 * 9/2013 Cottone ..... B65G 61/00 414/730

FOREIGN PATENT DOCUMENTS

DE 29921296 5/2000
EP 1717149 2/2006
EP 2276669 B1 * 8/2013 ..... B65B 11/006

OTHER PUBLICATIONS

International Search Report for PCT/IB2018/060025 dated Mar. 7, 2019 (2 pages).

* cited by examiner

*Primary Examiner* — Nathaniel C Chukwurah
*Assistant Examiner* — Mary C Hibbert-Copeland
(74) *Attorney, Agent, or Firm* — Tutunjian & Bitetto, P.C.

(57) ABSTRACT

A device for applying top sheets on palletised loads, including at least one support for at least one palletised load, of the feeding means of top sheets (C) to be applied on the palletised loads, suitable to unwind at least one film reel (B) from which a plurality of such sheets (C) can be obtained, and at least one applicator member suitable to place, one by one, the top sheets (C) obtained from the reel (B), over the top of respective palletised loads. The applicator member includes at least one robotic arm, having at least one operating end, and at least one winding and unwinding member, associated with such operating end; the winding and unwinding member is able to wrap the sheet (C), taken from the reel (B), on a wrapping surface to take a substantially tube-shaped configuration, and then to unwind it over the top of the palletised load.

20 Claims, 8 Drawing Sheets

(58) Field of Classification Search
USPC ..... 53/441
See application file for complete search history.

DEVICE FOR APPLYING COVER SHEETS TO PALLETISED LOADS

TECHNICAL FIELD OF THE INVENTION

The present invention relates to a device for applying top sheets to palletised loads.

In particular, the present invention relates to a device for applying upper top sheets to palletised loads, on which the automated wrapping is performed in wrapping machines.

PRIOR STATE OF THE ART

In the packing sector, palletised loads, i.e. items stacked on load pallets, are bound by automatic wrapping machines with special packing films, so as to easily transport the items and preserve their integrity.

Such wrapping machines further comprise devices that apply top sheets over the top of the palletised loads to be wrapped, so as to preserve them from water or dust which otherwise could deposit and/or penetrate inside the loads themselves.

The wrapping machines can be of various types, for example with a rotating table which supports the load to be wrapped, or of another type; depending on whether the palletised load wrapping has to be anti-dust or anti-water, the film is wrapped around the load itself in different ways, and also the top sheet is consequently applied at different times. More in detail, the anti-dust type wrapping mode provides, in a first step, the application of the top film over the top of the palletised load, and then the wrapping of the film starting from the top and then descending towards the base; in the anti-water wrapping mode, on the contrary, in a first step the film is wrapped starting from the base of the load and then rising towards the top, and only afterwards the top film is applied.

In both wrapping modes, the film must be applied in such a way that the upper top sheet is securely held in position to prevent the penetration of external agents.

In machines of known type, the device for applying the upper top sheet comprises a portal structure, arranged above the feed line of the palletised load through the machine. With reference to the aforementioned anti-dust wrapping mode, upon the passage of the load, and before carrying out the lateral wrapping with the film, the application device unwinds a sheet of prefixed length from a specific reel supported in a raised position, cuts it to measure and places it over the top of the load itself.

To achieve this, the application device must be at the correct distance from the top of the palletised load, which naturally varies from case to case.

Immediately after the application of the top sheet, the load is brought above a rotating table, and over the top of the same load a counter-table, also rotatable, is positioned, which keeps the top sheet in the correct position for locking it.

Subsequently, a winding head, which supports a film reel suitable for lateral wrapping of the load, is placed next to the load itself; the winding head is put in rotation and the film, after being suitably pre-stretched, is wrapped around the load according to the desired mode.

In the case, instead, of the anti-water wrapping mode, in which, as mentioned, the application of the top sheet takes place after the lateral wrapping, it is not possible to proceed in the manner described above: it is then necessary to provide an additional positioning member in the machine (e.g., an arm provided with pliers, or the like), which at the end of the lateral wrapping step on the rotating table provides for applying the top film over the top of the palletised load.

Such positioning member is specifically designed to perform this function, and therefore it involves a constructive complication of the machine, as well as an increase in overall dimensions.

In other machines of the known type (such as, e.g., the one described in the document EP 1717149), the device for applying the top sheet is mounted on a portal structure, which can rotate around a horizontal axis.

More in detail, the portal structure can rotate between a vertical position, for picking up the single sheet from a suitable reel supported below it, to a position tilted with respect to the vertical one and directed towards the load, wherein the sheet is laid down over the top of the load.

The machines of the type described above have some drawbacks.

Firstly, it is observed that, in its transfer from the application device, supported by the portal structure, to the top of the load, the top sheet, which is held at a single side, can undergo accidental and uncontrolled movements or crinkles, mainly due to the fact that it can be electrically charged, e.g., by rubbing.

In this case it may happen that the sheet, accidentally moved or crinkled due to the electrostatic attraction, is laid down over the top of the load in an incorrect way, and this could compromise the perfect seal to water or dust of the wrapping that will be subsequently carried out.

Additionally, the installation of the application device on a bulky portal structure imposes various restrictions from the point of view of the design of the machine layout: more in detail, in the case in which the application device is installed above the palletised load transport line, it is necessary to provide sufficient space in the plant, and this obviously binds the plant designer to make obligatory choices.

In addition, equally penalizing for the plant designer is the fact that the application of the top sheet is obligatory carried out in a given position of the operating cycle since, as said, the applicator device is fixed with respect to the machine and to the transit line of palletised loads: even this circumstance obviously greatly limits the machine's operational possibilities.

Furthermore, it may not be possible to install the machine in a certain already existing packing/packaging line, for reasons of overall dimensions of the machine itself and/or of the various equipment already provided in the line.

SUMMARY OF THE INVENTION

The task of the present invention is to improve the state of the art.

Within the scope of such technical task, it is an object of the present invention to realise a device for applying top sheets to palletised loads which allows to overcome the above-mentioned drawbacks.

Another object of the present invention is to develop a device for applying top sheets to palletised loads which is not affected by undesirable and uncontrollable phenomena due to the electrification of the sheet during its transfer from the reel to the top of the load.

A further object of the present invention is to develop a device for applying top sheets to palletised loads which is more flexible and versatile with respect to devices of the known type.

Another object of the present invention is to provide a device for applying top sheets on palletized loads which allows the space available in the production plant to be optimally managed.

Last but not least object is to develop a device for applying top sheets to palletised loads which is simplified from a constructive and structural point of view, and therefore more economical as regards installation and management costs.

This task and these objects are achieved by the device for applying top sheets to palletised loads according to the present application.

The device comprises at least one support for at least one palletised load, and feeding means of top sheets to be applied to the palletised loads, suitable for unwinding at least one film reel from which a plurality of the aforementioned sheets can be obtained.

Moreover, the device comprises at least one applicator member, suitable to position, one by one, the top sheets obtained from the reel over the top of respective palletised loads. According to the invention, the applicator member comprises at least one robotic arm, having at least one operating end, and at least one winding and unwinding member, associated with said operating end.

The winding and unwinding member is able to wrap the sheet, taken from the reel, on a wrapping surface so as to take a substantially tube-shaped configuration, and then to unwind it over the top of the palletised load in a stretched configuration.

Thanks to this solution, the transport of the top sheet takes place in a compact and orderly configuration, which is not affected by external actions that cannot be controlled (such as, e.g., electrostatic attractions, but not only), and which therefore allows the sheet to reach the top of the palletised load under the desired conditions.

This task and these objects are also achieved by the winding machine of palletised loads according to the present application, comprising the application device according to the present application, and the application process according to the present application.

The present application refers to preferred and advantageous embodiments of the invention.

BRIEF DESCRIPTION OF THE DRAWINGS

The characteristics of the invention will be better understood by anyone skilled in the art by the following description and the accompanying drawings, given as a non limiting example, wherein.

DETAILED DESCRIPTION OF THE INVENTION

Figure 1:
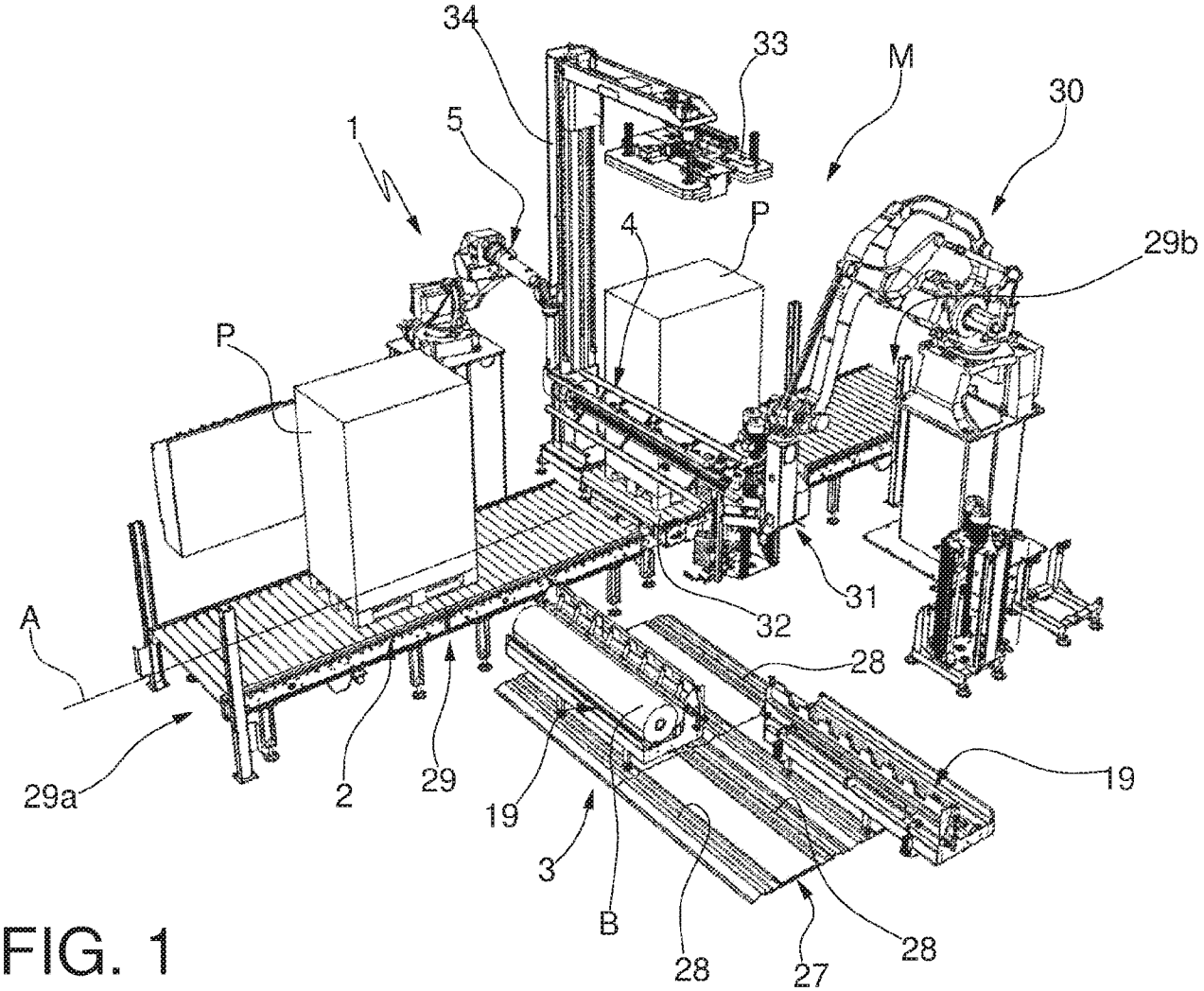
FIG. 1 is a perspective view of a wrapping machine for palletised loads, comprising the device for applying a top sheet according to the present invention.

With reference to the attached FIG. 1, a device for applying top sheets to palletised loads according to the present invention is indicated as a whole with 1.

As will be better explained below, the device 1 can be integrated into a wrapping machine M for palletised loads P, which also forms the object of the present invention.

It should be noted that in the attached figures, for a better understanding, the device 1 is shown together with the other groups or components of the wrapping machine M in which it is integrated; however, it should be noted that the present invention specifically protects the device 1 also completely independently from the other characteristics of the wrapping machine M of which it (possibly) forms part.

The device 1 comprises at least one support 2 for at least one palletised load P.

More in detail, the support 2 defines the prefixed position in which the palletised load P is located to be subjected to the application of a respective top sheet C over the top.

Each of the palletised loads P reaches the support 2 moving along a determined advancement direction A (which can coincide, e.g., with the advancement direction of the palletised loads P through the wrapping machine M which—possibly—comprises the device 1).

The device further comprises means 3 for feeding the top sheets C to be laid down on the palletised loads P.

More particularly, the feeding means 3 are suitable to unwind at least one top film reel B.

From the top film reel B a plurality of the aforementioned sheets C to be applied over the top of the palletised loads P can be obtained.

For this purpose, the feeding means 3 comprise cutting members 3*a*, better described hereinafter, to separate top sheets C of the desired size.

The device 1 also comprises at least one applicator member 4.

The applicator member 4, is suitable to position, one by one, the top sheets C obtained from the reel B over the top of respective palletised loads P.

According to an aspect of the invention, the applicator member 4 comprises at least one robotic arm 5.

In an embodiment of the invention of particular practical interest, the robotic arm 5 is of the anthropomorphic type, but could also be of another type suitable for the application (e.g., a Cartesian one).

The robotic arm 5 comprises at least one operating end 5*a*.

According to another aspect of the invention, the applicator member 4 comprises a winding and unwinding member 6.

The winding and unwinding member 6 is associated with the operating end 5*a* of the robotic arm 5.

The winding and unwinding member 6 is suitable to take each top sheet C unwound from the reel B at least at one of its edges D, and to position it over the top of a respective palletised load P, as will be better described hereinafter.

More in detail, the winding and unwinding member 6 is able to wrap the sheet C, taken from the reel B, so as to take a substantially tube-shaped configuration, and then to unwind it over the top of the palletised load P, so that the transport of the sheet C itself takes places in a configuration in which it cannot undergo accidental movements.

The robotic arm 5 is constituted by mutually articulated portions, associated with respective rotating actuators, so as to position the operative end 5*a* in the desired points of the space, and further to move the same operative end 5 *a* from a starting point to an arrival point with the desired speed and acceleration.

The above-mentioned starting point typically consists of the pick-up point of the top sheets C provided in the feeding means 3; the above-mentioned arrival point, instead typically consists of a suitable position near the top of the palletised load P, to deposit said sheet C on it.

The robotic arm 5 further comprises a base 5*b*, opposed to the operating end 5*a*, positioned next to the support 2 of the palletised load P.

The base 5*b* can house the actuating and control means of the robotic arm 5.

According to an aspect of the invention, the base 5*b* of the robotic arm 5 can be placed, with respect to the support 2, in the position which is considered optimal in relation to various aspects, such as the overall plan dimensions of the device 1, the modalities of achievement of the starting point and the arrival point of the operating end 5*a* of the robotic arm, the trajectory that the operating end 5*a* must cover during the movement between the above mentioned points, and others.

The winding and unwinding member 6 comprises a support element 7.

According to another aspect of the invention, the winding and unwinding member 6 comprises gripping means 8.

The gripping means 8 can be associated with the support element 7, or with other parts of the winding and unwinding member 6.

As better explained hereinafter, the gripping means 8 are suitable for grasping the edge D of the film of the reel B, to take from it a top sheet C to be laid down over the top of the palletised load P.

Figure 2:
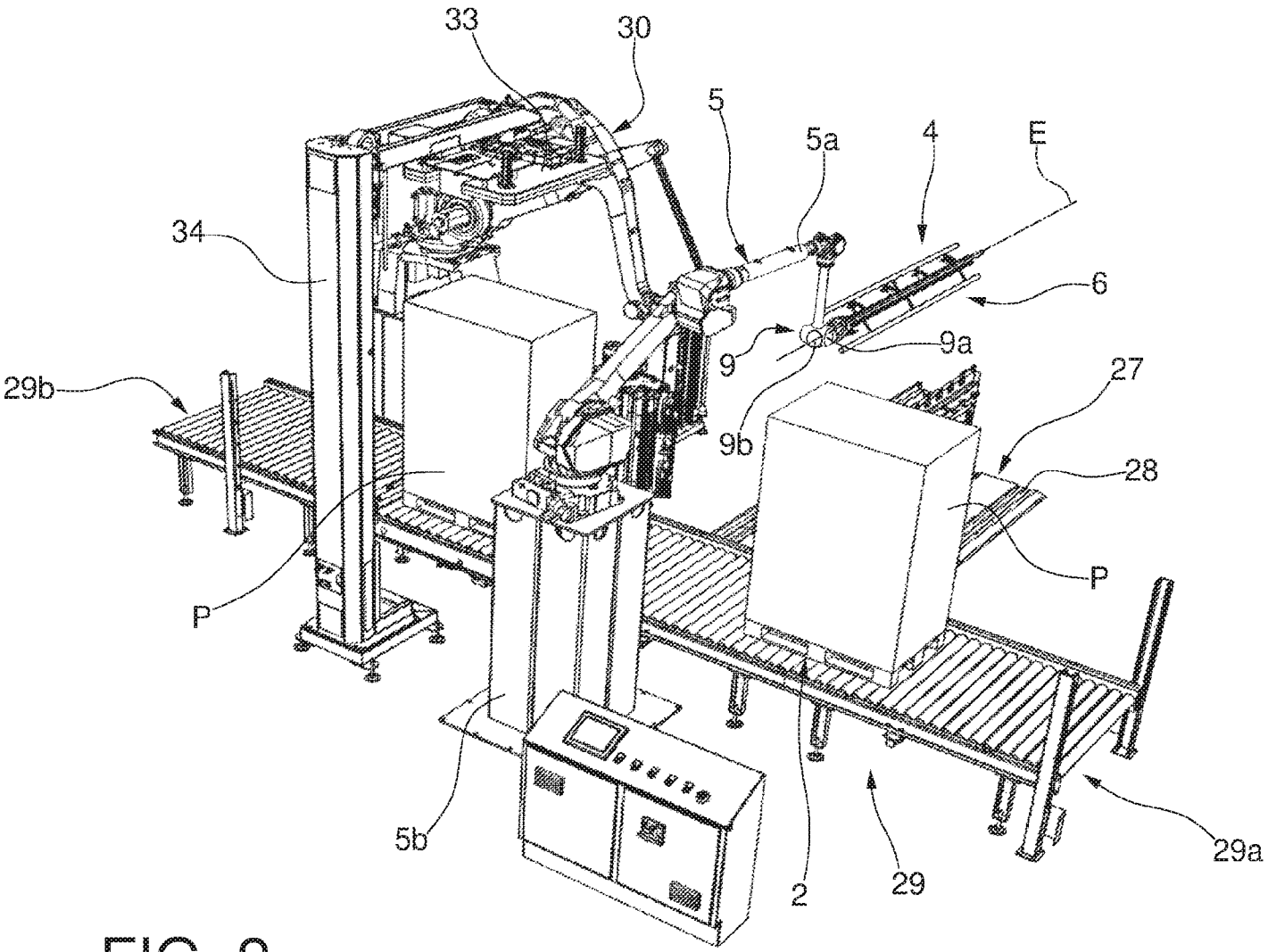
FIG. 2 is a perspective of the same machine, from a different angle.

The robotic arm 5 comprises a joint 9 (FIG. 2), which connects the winding and unwinding member 6 to the operating end 5*a*.

The joint 9 is of rotating type; the joint 9 comprises in fact a first actuator 9*a* which allows to selectively tilt the winding and unwinding member 6 with respect to the operating end 5*a*.

Furthermore, the joint 9 comprises a second actuator 9*b*.

The second actuator 9*b* has the function of performing the selective rotation of the winding and unwinding member 6 around the winding and unwinding axis E, for the reasons better explained below.

Preferably, each of the first actuator 9*a* and the second actuator 9*b* comprises a respective electric motor, possibly associated with a speed reducer; however, it is not excluded that in other embodiments of the invention the first actuator 9*a* and the second actuator 9*b* are of different types (e.g., pneumatic, hydraulic type).

Figure 3:
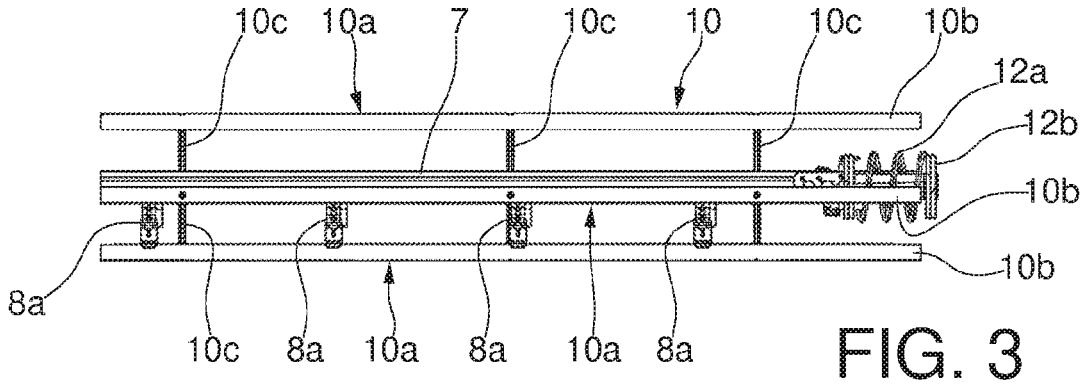
FIG. 3 is a lateral view of the winding and unwinding member of the device.

The support element 7 has an elongated conformation; for example, the support element 7 can consist of a section, made of light material (see, e.g., FIG. 3).

Such section can have such a shape as to define peripheral slots—e.g., channels, or grooves—for fixing the gripping means 8, e.g., positioned at certain mutual distances, so as to obtain the optimum grip of the edge D of the film of the reel B.

The support element 7 is connected—directly or by interposing additional connection elements—to the joint 9.

According to another aspect of the invention, the winding and unwinding member 6 comprises at least a wrapping surface 10 of the film of the reel B.

In particular, the wrapping surface 10—cooperating with the gripping means 8—allows the wrapping around it of a top sheet C, in its way from the feeding means 3 to the palletised load P, on the top of which it must be laid down.

As will become clearer hereinafter, thanks to the wrapping of the sheet C on the wrapping surface 10, the drawbacks due to the fact that the sheet C can freely and uncontrollably move/crinkle during its way from the feeding means 3 to the palletised load P are eliminated, reaching the top of the load P itself in a non-optimal configuration.

Thanks to this important feature, instead, sheet C can be unwound, in an extremely precise and controlled manner, by the wrapping surface 10 directly over the top of the palletised load P, avoiding crinkles or other possible deformations or incorrect positioning.

The wrapping surface (10) can be shaped in various ways.

One of the main requirements relating to the winding and unwinding member 6 is the low weight since, as said, it is associated with the operating end 5*a* of a robotic arm 5. Consequently, in the practical realisation of the wrapping surface 10, also the overall weight of the winding and unwinding member 6 is taken into account.

For this reason, in an embodiment of the invention of particular practical interest, the wrapping surface 10 comprises a plurality of portions 10*a*, distinct and separate from each other, arranged around the support element 7.

More particularly, each of the portions 10*a* of the wrapping surface 10 comprises a respective peripheral element 10*b*.

The peripheral element 10*b* can have an open or closed cross-section.

In the specific embodiments shown in the figures, the peripheral element 10*b* has a closed cross-section: in other words, it consists of a tube-like element.

Such tube-like element may have a circular or a substantially circular cross-section, or another form suitable to realise a wrapping surface free from corners or roughness which could damage the sheet C.

Each peripheral element 10*b*—on which the top sheet C is wrapped—is positioned at a certain distance from the support element 7, so as to obtain the desired winding radius. More in detail, the peripheral element 10*b* is connected to the support element 7 by at least one connecting element 10*c*.

The connecting element 10*c* consists, e.g., of a small arm; this small arm is arranged perpendicular to the longitudinal axis of the support element 7.

For greater solidity and stability of the assembly, each portion 10*a* of the wrapping surface 10 comprises a certain number of connecting elements 10*c* of the peripheral element 10*b* to the central support element 7; for example, three or four connecting elements 10*c* may be provided.

The number and sized of the portions 10*a* are designed on the basis of a compromise between the desired extension of the wrapping surface 10 and the overall weight of the winding and unwinding member 6.

In the embodiments shown in the figures, the winding and unwinding member 6 comprises, e.g., four portions 10*a* which make up the wrapping surface 10.

Figure 5:
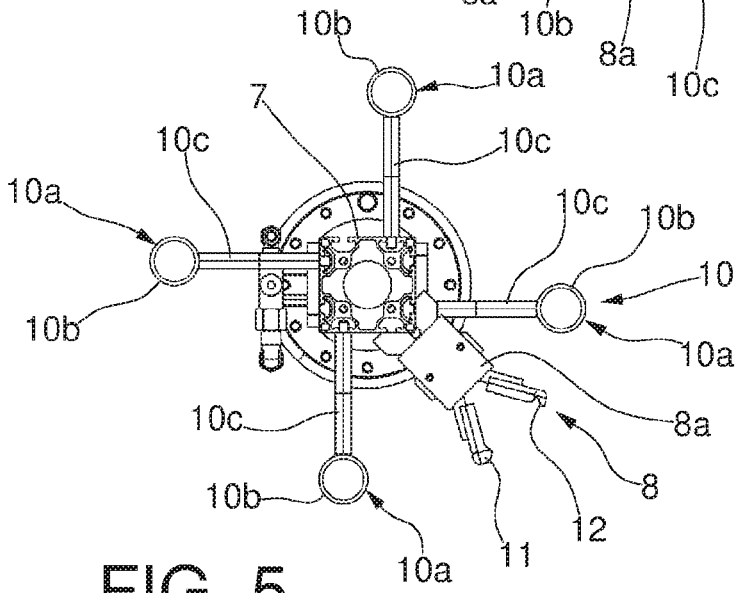
FIG. 5 is a front view of the winding and unwinding member.

As underlined, e.g., in FIG. 5, the four portions 10*a* are arranged angularly equidistant, positioned at 90° one with respect to the other.

Obviously, different locations of the portions 10*a* are possible, depending on their total number.

Still with reference to the specific embodiments shown in the figures, the gripping means 8 comprise one or more pliers 8*a*, arranged along the support element 7.

For example, the gripping means 8 comprise four pliers 8*a*.

The pliers 8*a* can be positioned substantially equidistant from each other along the support element 7, for an optimum grip of the edge D of the film of the reel B.

Each plier 8*a*, as shown, e.g., in FIG. 5, comprises a first member 11 and a second member 12.

The first member 11 and the second member 12 are mutually movable between an open position and a closed position for gripping the edge D of the film of the reel B.

Figure 4:
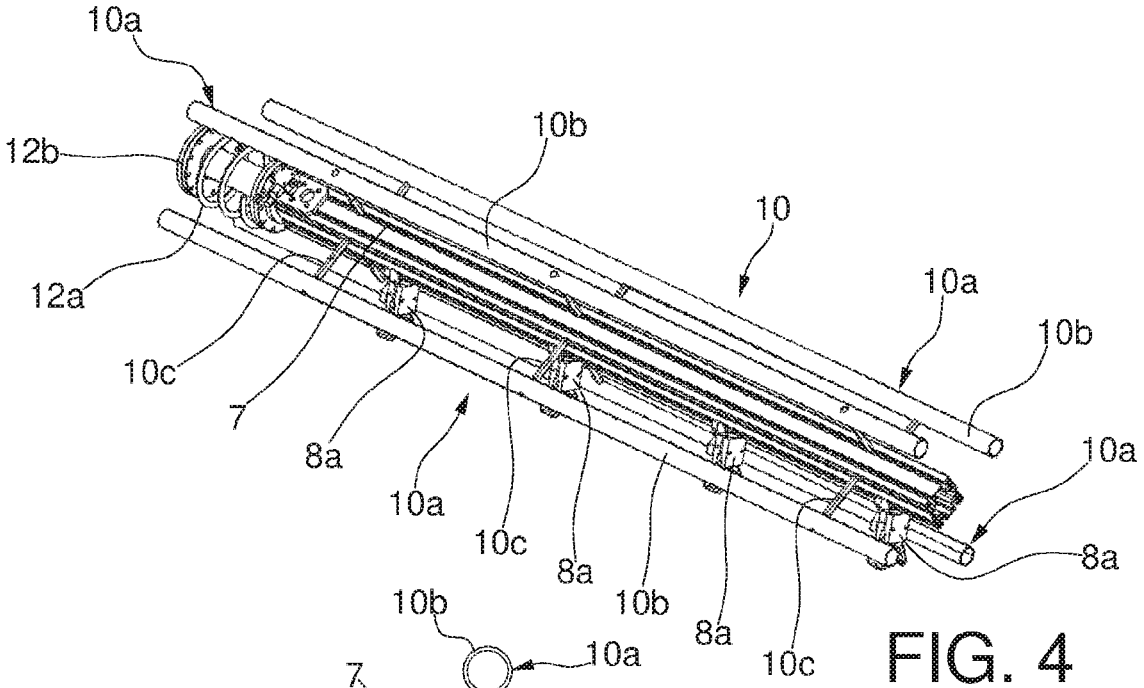
FIG. 4 is a perspective view of the winding and unwinding member.

The actuation of the first member 11 and of the second member 12 of each plier 8 can be, e.g., of a pneumatic type (not all the components of the pneumatic feeding system of the pliers 8 are shown, in particular, in FIGS. 3, 4, 5 for simplicity): this is a particularly simple and economical type of actuation, which also guarantees a certain operating speed.

In FIGS. 3,4, a duct 12*a* for feeding pressurized air to the pliers 8 is schematically illustrated; such duct is suitably wrapped on a respective flanged support 12*b*, connected in turn to the joint 9.

The duct 12*a* has a length sufficient to allow rotation of the winding and unwinding member 6 for the number of turns necessary to wind/unwind the film C, in the various operating steps of the device 1.

However, other possible actuation types of the pliers 8 (e.g., an actuation with electric actuators) are not excluded.

Figure 13:
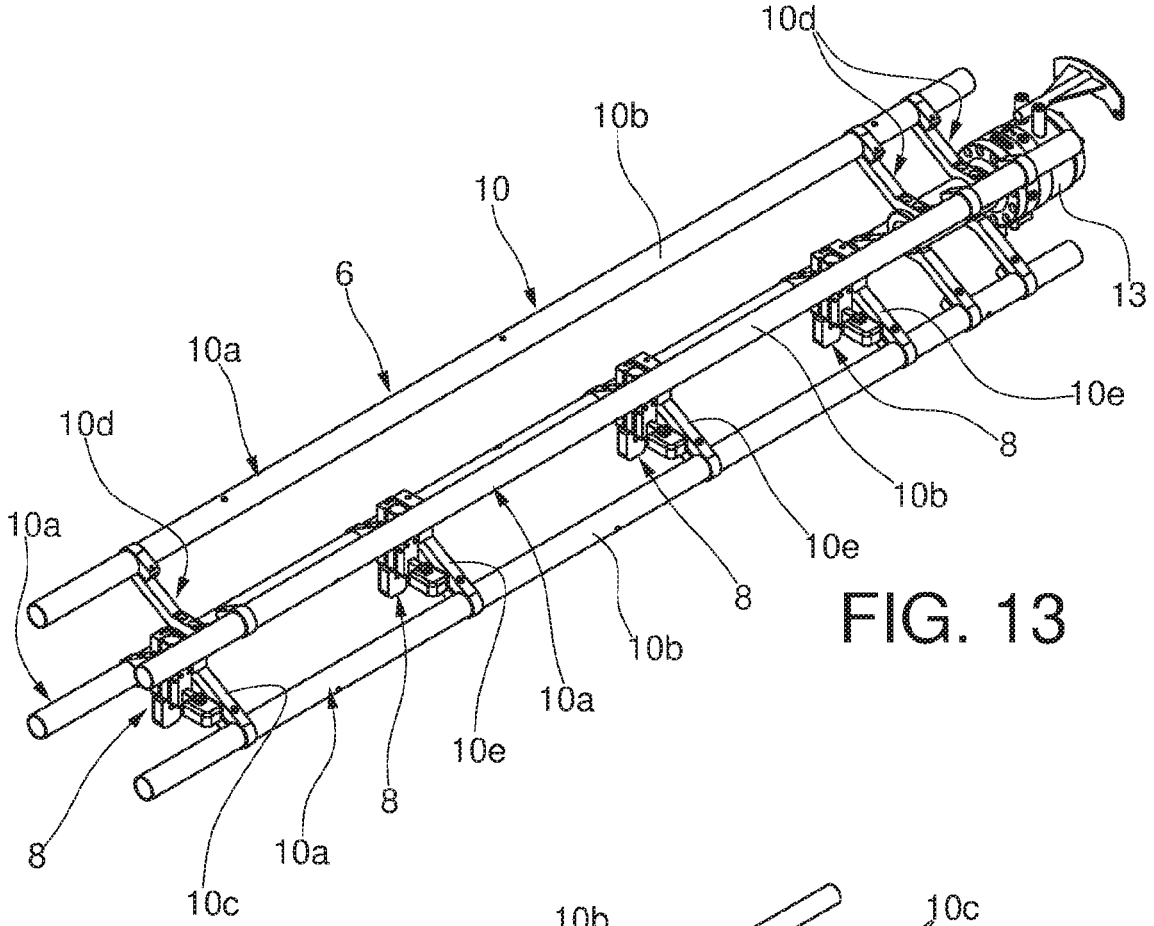
FIG. 13 is a perspective view of winding and unwinding member according to another embodiment of the invention.
Figure 14:
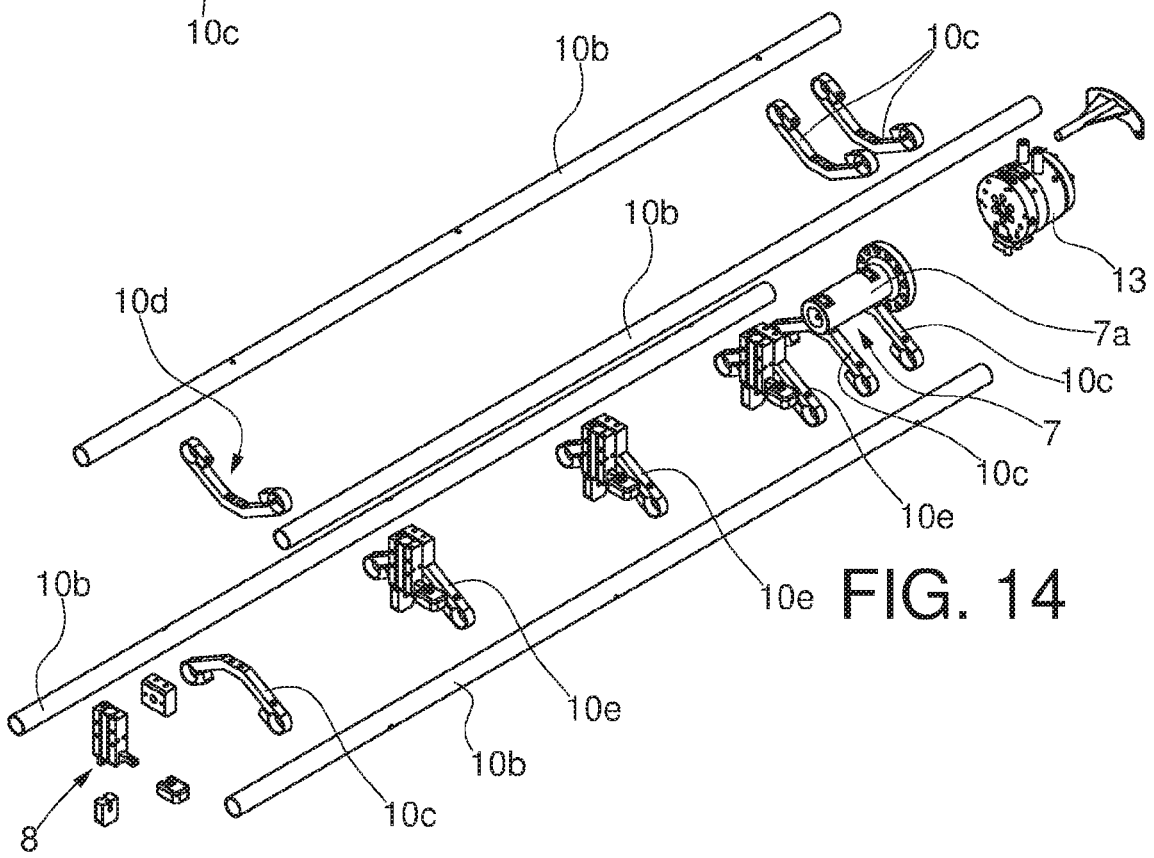
FIG. 14 is an exploded perspective view of the same winding and unwinding member of FIG. 13.

A possible alternative embodiment, and of particular practical interest, of the winding and unwinding member 6 is shown in FIGS. 13, 14; it is a version improved from many points of view.

Firstly, in this embodiment the winding and unwinding member 6 comprises a rotating pneumatic joint 13 for feeding compressed air to the gripping means 8.

This arrangement allows, in particular, to eliminate the duct 12*a*, thus obtaining a more practical solution having a safer and more reliable operation.

Moreover, with respect to the version of FIGS. 3-5, the support element 7 is considerably reduced in size.

More in detail, in this case the support element 7 comprises a tube-like body 7*a*.

The tube-like body 7*a* is directly connected to the rotating joint 13, at a first end of the winding and unwinding member 6.

Connecting elements 10*c* are connected to the tube-like body 7*a*; the latter are, in turn, connected to the peripheral elements 10*b* of the portions 10*a* of the wrapping surface 10. Further connecting elements 10*c* are provided at the end of the winding and unwinding member 6 opposite to that in which the rotating joint 13 is provided.

The connecting elements 10*c* are connected to each other in such a way as to define one or more sorts of crosses 10*d* (in the case in which the peripheral elements 10*b* are four in number).

Such crosses 10*d* connect the peripheral elements 10*b* to each other at certain positions; for example, such crosses 10*d* connect the peripheral elements 10*b* with each other only at the ends of the winding and unwinding member 6, so that it is no longer necessary to provide (as in the embodiment of FIGS. 3-5) a central support element 7 having a length equal to that of the winding and unwinding device 6.

The consequence is a remarkable constructive simplification, and a considerable reduction of the overall weight of the winding and unwinding member 6.

In the absence of the central support element 7 which runs along the entire length of the winding and unwinding member 6, the pliers 8*a* are, in this case, connected to the peripheral elements 10*b* by means of further connecting elements 10*e*, comprising the small arms.

A member considerably slimmer and lighter is therefore obtained, while maintaining the same functionalities as the one illustrated in FIGS. 3-5; moreover, the solution of FIGS. 13, 14 allows the sheet C to be wrapped even for a greater number of turns, since the mechanical constraint constituted by the duct 12*a* has been eliminated.

The feeding means 3 comprise selective locking means 14 of the edge D of the film of the reel B.

The selective locking means 14 are suitable to keep the edge D in the correct position to allow the gripping means 8 of the winding and unwinding member 6 to grasp it, so as to take a top sheet C.

More in detail, since the film of the reel B—usually made of plastic material—may be subject to uncontrollable electrostatic attractions that could accidentally move, crumple or wrinkle it if left free, according to an aspect of the present invention the edge D of the film of the reel B is firmly held and locked while waiting for the winding and unwinding member 6 to grasp it to take a top sheet C.

The selective locking means 14 comprise at least a first locking element 15 and a second locking element 16.

The first locking element 15 and the second locking element 16 are mutually movable between a free passage position of the film of the reel B, wherein they are spaced from each other, and a locking position of the film, wherein they are, instead, mutually in contact so as to clamp the edge D between them.

The first locking element 15, which can be completely flat, has respective first openings 15*a*.

Such first openings 15*a* allow the gripping means 8 of the winding and unwinding member 6 to grasp the edge D of the film of the reel B, to grasp and take the top sheets C one by one.

The first openings 15*a* are positioned substantially at the same distance from each other at which the gripping means 8 of the winding and unwinding member 6 are positioned from each other.

The second locking element 16, which, as mentioned, is movable with respect to the first locking element 15, comprises a revolving body 16*a*, provided with a plurality of extensions 16*b*.

The extensions 16*b* are suitable to match with the edge D of the film of the reel B, keeping it in the correct position to be grasped by the gripping means 8.

The selective locking means 14 are mounted on a frame 17 for supporting the feeding means 3.

The frame 17 is substantially shaped as a sort of elongated tank, inside which the top film reel B is supported, in the manner better described hereinafter.

The first element 15 and the second element 16 are supported at one of the edges of the frame 17, and in particular at the highest of the two edges of the frame 17 arranged along its long sides.

More in detail, the first element 15 can be completely flat; the second element 16 may have the terminal edge 16, arranged according to the longer, raised side, so as to create a constraint against the exit of the edge D of the film of the reel B.

The revolving body 16*a* can rotate about a rotation axis R parallel to that of the top film reel B.

The revolving body 16*a* is associated with at least one actuation mechanism 18, adapted to rotate the same revolving body 16*a* between the free passage position of the film of the reel B and the selective locking position thereof.

The actuation mechanism 18 comprises at least one linear actuator 18*a*, associated with a respective crank gear 18*b*; the crank gear 18*b* is suitable to transform the translation motion of the stem of the actuator 18*a* into a rotation motion of the revolving body 16*a*. More in detail, in the embodiment shown in the figures, the actuation mechanism 18 comprises two linear actuators 18*a*, associated with respective crank gears 18*b*, supported at the opposite flanks of the frame 17 (or in other suitable positions).

In the embodiment shown in the figures, each of the linear actuators 18*a* is of the pneumatic type; in other embodiments of the invention, actuators 18*a* of another type could be provided, e.g. comprising one or more electric motors, or others.

The extensions 16*b* are mutually positioned so as to allow free operation of the gripping means 8 on the edge D of the film of the reel B.

According to another aspect of the invention, the feeding means 3 comprise at least one slot 19 for the reel of the top film B.

In the slot 19 the top film reel B is placed which must be unwound to obtain the individual sheets C to be applied on respective palletised loads P.

The slot 19 is provided inside the support frame 17, which as mentioned, is substantially shaped as a tank or, more generally, as an open container at the top.

Figure 9:
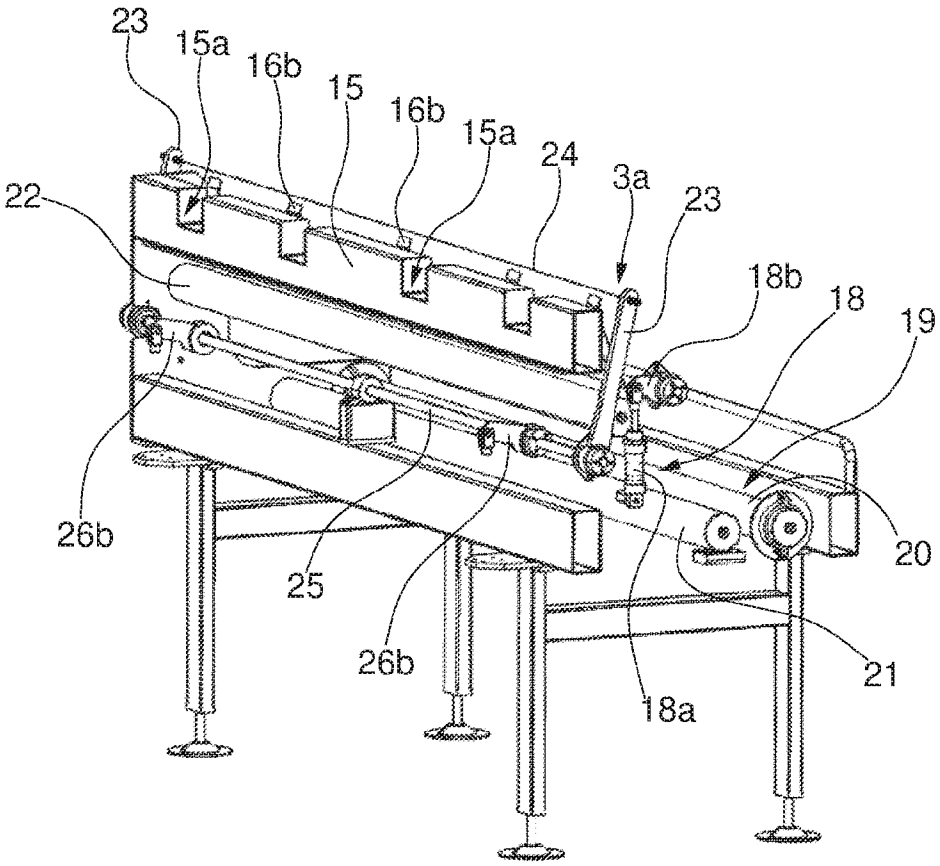
FIG. 9 is a further perspective view of the feeding means, with some parts removed for greater clarity.

As illustrated, e.g., in FIG. 9, the slot 19 comprises at least two unwinding rollers 20,21, with parallel axes, on which the top film reel B can roll.

The unwinding rollers 20,21 are rotatably supported in the flanks of the frame 17.

The unwinding rollers 20,21 may be both idle, or at least one of them may be associated with respective rotating actuating means.

The unwinding rollers 20,21 are rotatably supported in the bottom of the support frame 17.

The feeding means 3 further comprise at least one tensioning roller 22 of the film of the reel B; the tensioning roller 22 is rotatably supported in the flanks of the frame 17. Around the tensioning roller 22 the film unwound from the aforementioned reel B is wrapped, then held in position by the selective locking means 14.

Therefore, in use, the reel B is placed on the unwinding rollers 20,21, and the edge D thereof is wrapped around the tensioning roller 22, and then inserted between the selective locking means 14.

As mentioned, at least one of the two unwinding rollers 20,21 can be motorized to facilitate unwinding of the reel B; alternatively, the unwinding of the reel B can be obtained directly by the traction exerted on its edge D by the winding and unwinding member 6.

The cutting members 3*a* of the film unwound from the reel B can be, e.g., of the heated wire type.

Figure 7:
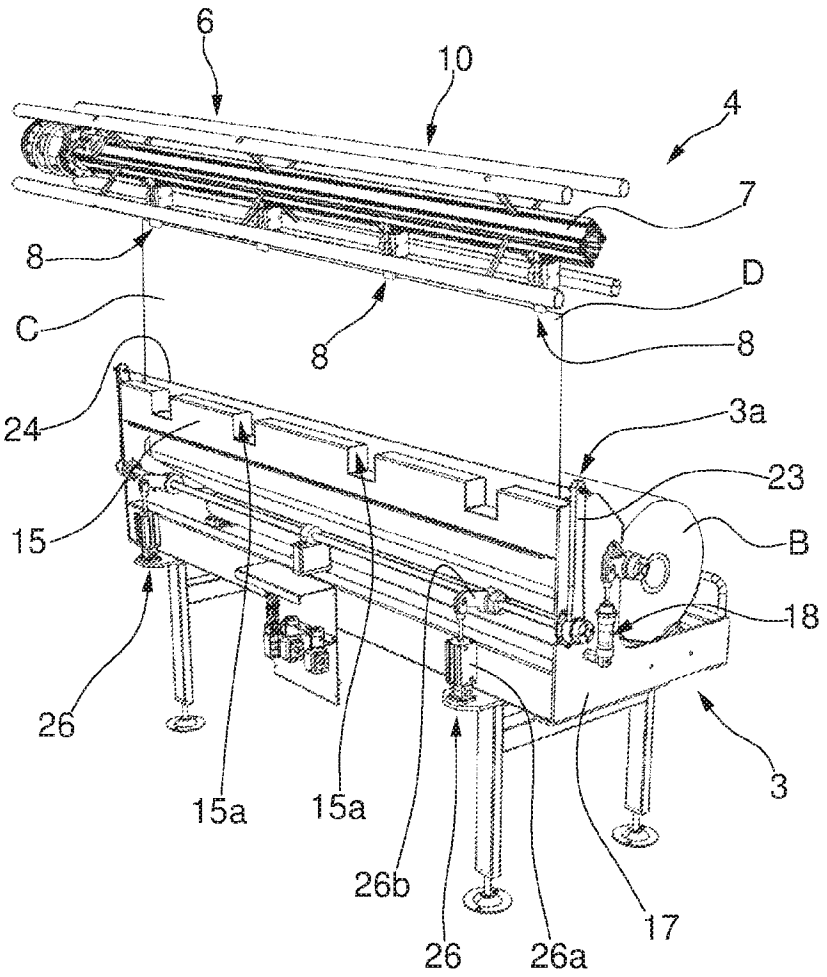
FIG. 7 is a detailed perspective view, with some parts removed for greater clarity, of the feeding means and of the winding and unwinding member, in a step of picking up a sheet.
Figure 6:
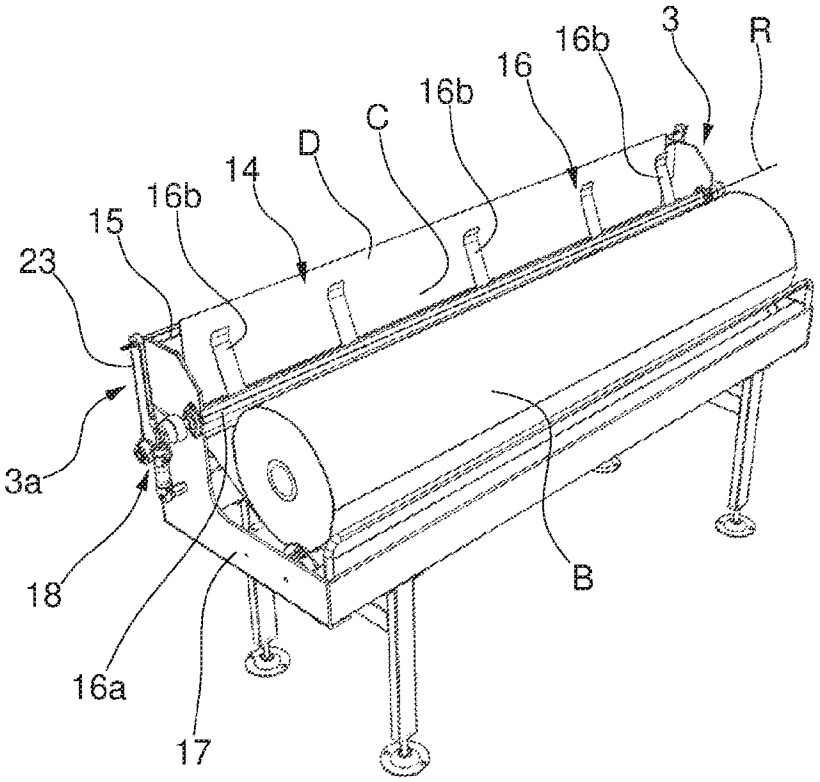
FIG. 6 is a perspective view of the feeding means.
Figure 8:
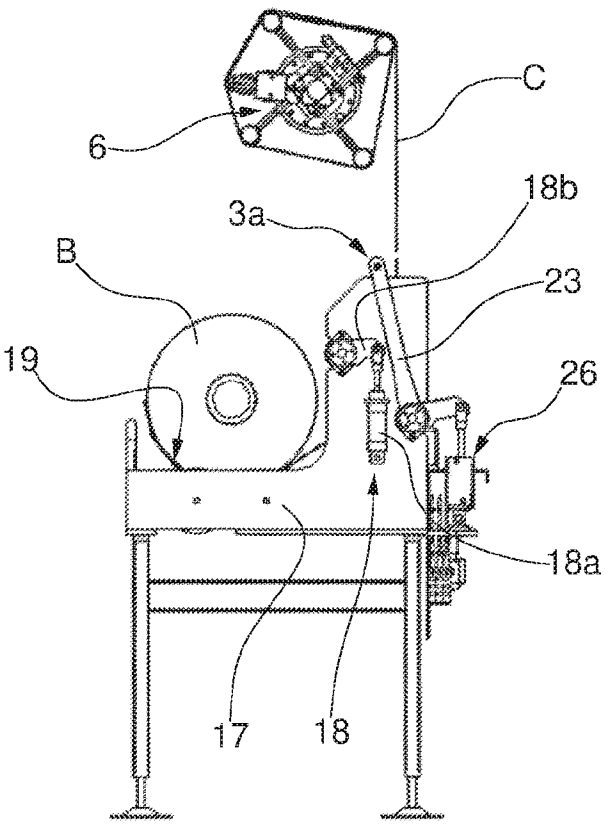
FIG. 8 is a detailed lateral view, with some parts removed for greater clarity, of the feeding means and of the winding and unwinding member, in a subsequent step of picking up a sheet.

As shown, e.g., in FIGS. 7,8, the cutting members 3*a* comprise a pair of arms 23 articulated to the frame 17, to which the ends of a heated wire 24 are connected; the heated wire 24 is arranged parallel to the axis of the reel B.

The arms 23 are mutually connected by a shaft 25, rotatably supported by the frame 17. The cutting members 3*a* further comprise actuating means 26, which allow the heated wire 24 to be brought from the inactive position (shown in FIG. 7) to the cutting position (shown in FIG. 8), in which it cuts off the film of the reel B to allow the picking up by the winding and unwinding member 6.

In the embodiment shown in the figures, the actuating means 26 comprise at least one linear actuator 26*a* associated with a respective crank gear 26*b* which is in turn coupled to the shaft 25; the crank gear 26*b* transforms the translation motion of the stem of the linear actuator 26*a* into the rotation motion of the shaft 25, with an angular excursion such as to allow the heated wire 24 to pass from the inactive position to the cutting position.

In particular, two or more linear actuators 26*a*, articulated to the frame 17 and associated with two respective crank gears 26*b*, the latter coupled, in turn, to the shaft 25, can be provided.

It should be noted that the cutting members 3*a* could also be of a different type from the one described, e.g., they could include fixed or movable blades, or other elements suitable to carry out the cutting of the film of the reel B.

According to another aspect of the invention, the slot 19 for the reel B can be movable between at least an operating position and a replacement or maintenance position, or even a waiting position.

In the above-mentioned operating position, the slot 19 of the reel B is optimally arranged to allow the picking up of the individual sheets C by the winding and unwinding member 6.

In the replacement/maintenance/waiting position, instead, the slot 19 of the reel B is arranged so as to allow the operators to carry out easily and safely their possible interventions.

According to another aspect of the invention, the feeding means 3 can comprise at least two slot 19 for two respective reels B.

As will be better described hereinafter, this allows to guarantee a continuity of operation of the device 1 in the case of exhaustion or jamming of one of the reels B: in other words, if one of the reels B is not available for some reason, the robotic arm 5 can take sheets C from the other reel B, so as not to interrupt the production cycle.

The two slots 19 for the respective reels B can be, e.g., side by side or overlapped.

In particular, in the embodiment of the invention illustrated in the figures, the device 1 comprises two slots 19 arranged side by side with each other, and each of them is movable between the aforementioned operating and replacement/maintenance/waiting positions.

As shown, e.g., in FIG. 1, each of the two slots 19 of the reels B can be slidable between said operating and replacement/maintenance/waiting positions: in the operating position, one or the other of the slots 19 is located near the robotic arm 5, while in the replacement/maintenance/waiting position one or the other of the slots 19 is, e.g., inside a protection, in which the operator can work in maximum safety.

According to a further aspect of the invention, the two slots 19 for the respective reels B have the respective support frames 17 sliding along a same base structure 27.

The base structure 27 comprises respective parallel guides 28, along which the two support frames 17 are slidable.

The sliding of each of the two frames 17 can be carried out in an automated manner, e.g. by means of respective actuators, or even possibly manually.

In other embodiments of the invention a greater number of slots 19 can also be provided for respective top film reels B.

The operation of the device 1 is, in the light of the foregoing, completely intuitive.

Once the palletised load P has reached the support 2, the robotic arm 5 approaches the feeding means 3; more in detail, the winding and unwinding member 6 approaches the feeding means 3.

At the same time, the edge D of the top film reel B is clamped by the selective locking means 14.

More in detail, the aforementioned edge D is interposed between the first locking element 15 and the second locking element 16; the extensions 16*b* matches the film of the reel B, and keep it in the correct picking up position.

The gripping means 8, in the open position, are then positioned at the first openings 15*a*, so as to interpose the edge D between the respective first, second members 11, 12.

The first, second members 11, 12 are then mutually approached, until they close, moving to the position for gripping the edge D of the film of the reel B.

After having grasped the edge D with the gripping means 8, the second actuator 9*b* is actuated, which causes the winding and unwinding member 6 to rotate in a certain direction of rotation.

The rotation of the winding and unwinding member 6, with the gripping means 8 which clamp the edge D, causes the tensile unwinding of the film from the reel B, and at the same time its wrapping around the portions 10*a*, for a suitable number of turns in relation to the plan dimensions of the palletised load P.

Once the winding and unwinding member 6 has picked up, therefore, a quantity of film suitable for covering the palletised load P, the cutting members 3*a*, which cut off the film, thus isolating a single sheet C are actuated.

Figure 10:
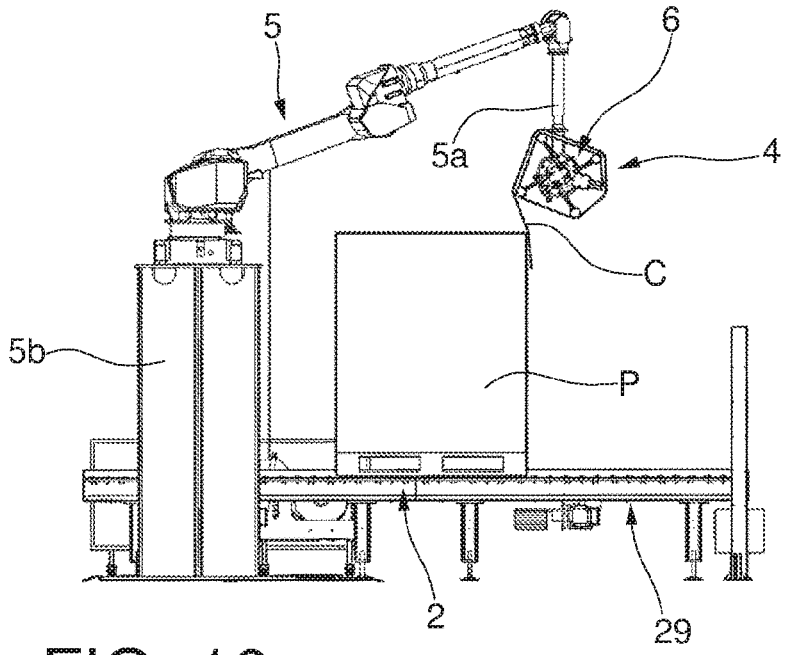
FIG. 10 is a detailed lateral view, with some parts removed for greater clarity, of the winding and unwinding member, in a step of laying down the sheet on the palletised load.

The robotic arm 5 then moves so as to bring the winding and unwinding member 6, carrying the sheet C, above the top of the palletised load P, as shown in particular in FIG. 10.

The sheet C, carefully wrapped on the portions 10*a* of the winding and unwinding member 6, is therefore completely blocked and immobile, and cannot move/crinkle even in the event that any electrostatic attraction from other bodies located in proximity thereto should occur.

Subsequently the step of laying down the sheet C over the top of the palletised load P begins.

The robotic arm 5 is actuated so as to translate the operating end 5*a* along a substantially horizontal trajectory above the top of the palletised load P; at the same time, the second actuator 9*b* is actuated so as to rotate the winding and unwinding member 6 in the unwinding direction of the top sheet C.

Figure 11:
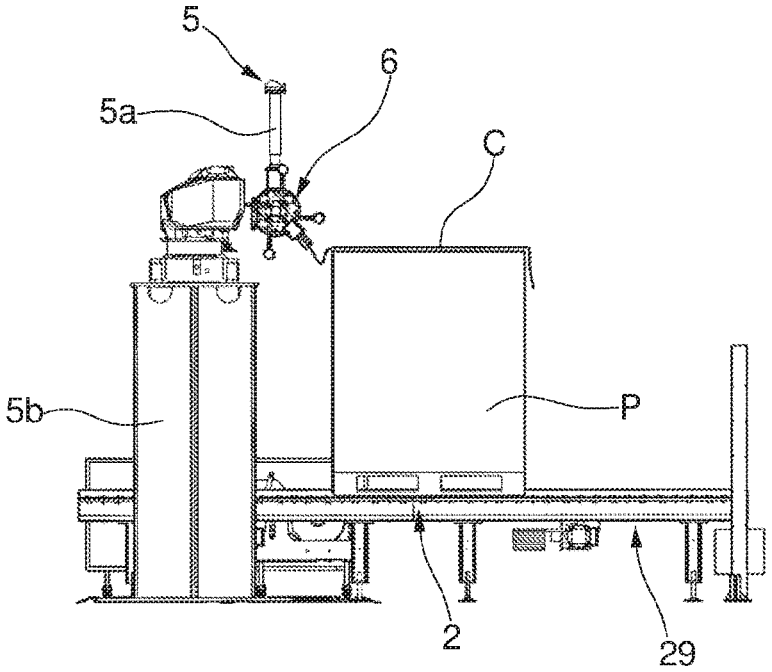
FIG. 11 is a detailed lateral view, with some parts removed for greater clarity, of the winding and unwinding member, in a subsequent step of laying down the sheet on the palletised load.
Figure 12:
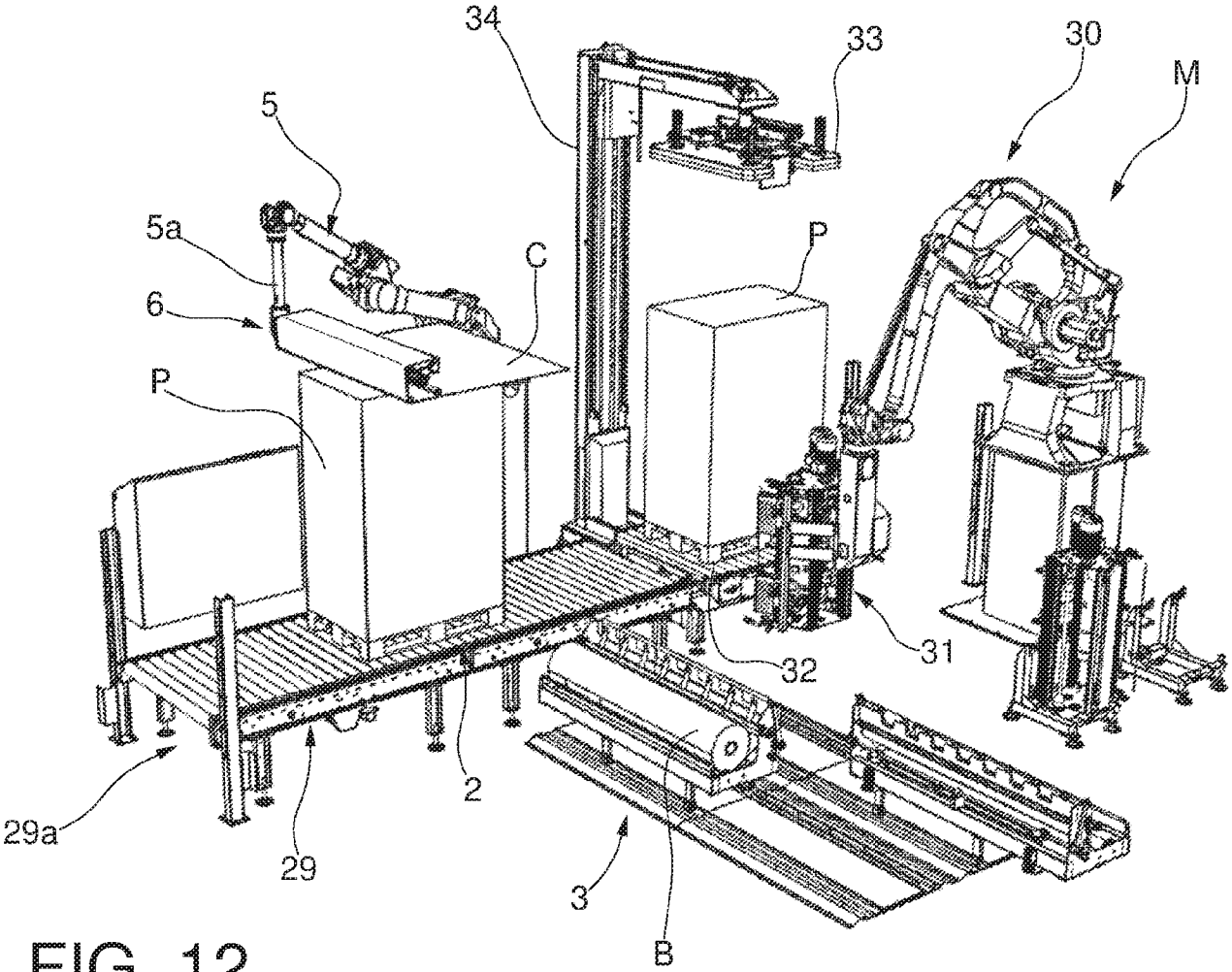
FIG. 12 is a perspective view of the wrapping machine, comprising the device according to the invention, in a step of laying down the top sheet on the palletised load.

In this way the sheet C is progressively stretched, in a very accurate and controlled manner, over the top of the palletised load P (FIGS. 11 and 12).

Once the unwinding process has been completed, and then the sheet C has been completely stretched over the top of the palletised load P, the gripping means 8 are actuated so as to open and release the sheet C itself.

The cycle of picking up and applying a new sheet C is repeated exactly as described.

In the case in which the film of the reel B is exhausted—and in the case in which the feeding means 3 comprise several slots 19 for respective reels B—the slot 19 carrying the exhausted reel B is brought into the maintenance/replacement/waiting position, while the other slot 19, carrying a full reel B, is brought into the operative position which is accessible to the robotic arm 5.

The same is true if the material to realise the sheets C has to be varied, or in the case where sheets C of different sizes have to be realised, which can then be obtained from respective different reels B.

The invention thus conceived enables the achievement of important technical advantages.

Firstly, as mentioned, the sheet C is transported from the feeding means 3 to the palletised load P in a configuration of complete wrapping around the portions 10*a*, and then into a configuration in which it cannot undergo accidental movements and/or deformations.

As a consequence of this, also the laying down of the sheet C over the top of the palletised load P takes place in a very precise and accurate manner, unwinding thereof by means of the member 6.

In this way, possible crinkles, movements or other unwanted phenomena that could lead to an incorrect positioning of the sheet C itself are avoided.

These results are obtained with a constructive solution of the winding and unwinding member 6 which is very simple, economical and light, particularly suitable to be mounted on an anthropomorphic robotic arm 5.

It should also be noted that the robotic arm 5 can be freely placed in the most suitable position with respect to the support 2 for the palletised load P; this guarantees a greater freedom for the layout designer of the packaging plant, since there are no constraints to provide the device 1 in a predetermined position, as it is the case with machines of the known type.

One of the main advantages deriving from this is the possibility of reducing the overall plan dimensions of the packaging plant, or adapting it to the available spaces.

Another advantage consists in the fact that the robotic arm 5 can be placed in the most suitable position in relation to the specific requirements of a particular wrapping job, e.g. in the case in which an anti-water or anti-dust wrapping is to be carried out, or to minimize the distance that the load P covers between the application of the sheet C and the subsequent lateral wrapping, or for other requirements, such as the reduction of the operating time of the wrapping machine.

Compared to machines of the known type, the solution according to the present invention also allows to obtain a constructive and functional simplification, since with a single robotic arm 5 it is possible to perform both the anti-dust and the anti-water wrapping.

In particular, it is no longer necessary to provide a specific positioning member of the top sheet for the anti-water wrapping mode, which is present in machines of the known type, since the same robotic arm 5 can indifferently apply the top sheet before or after the lateral wrapping step, and in any position the palletised load is located: it is sufficient to modify the way of the robotic arm 5 to obtain one or the other mode.

Moreover, the top film reel B is now in a much more convenient and accessible position for the operators with respect to what happens in the equipment of the known type, e.g. for carrying out maintenance and/or replacement operations.

An object of the present invention is also a wrapping machine M for palletised loads P, comprising at least one device 1 for applying top sheets having the characteristics described above.

The machine M comprises a feed line 29 of the palletised loads P; in particular, the palletised loads P are fed between an inlet 29*a* and an outlet 29*b*, opposite to each other. The feed line 29 can be, e.g., of the rollers type, or other equivalent type.

Moreover, the machine M comprises at least a wrapping device 30 of the palletised loads P.

The wrapping device 30 has the function of wrapping a wrapping film around the lateral surface of the palletised load P, so as to lock in position the top sheet C applied by the device 1.

The wrapping device 30 comprises at least one winding head 31; the winding head 31, in turn, supports a film winding reel around the palletised loads P.

The wrapping device 30 may comprise, e.g., a wrapping robotic arm which has the head 31 at its operating end.

The wrapping device 30 can also be of another type, e.g., of the type comprising a sort of column-shaped base, which extends vertically, along which the winding head 31 slides, to wrap the film around the palletised load P from top to bottom or from bottom to top, depending on the required wrapping mode.

The machine M further comprises at least one rotating table 32.

The rotating table 32 is rotatable about a vertical axis, in use.

More in detail, the rotating table 32 is provided along the feed line 29 between the inlet 29*a* and the outlet 29*b*.

The rotating table 32 also comprises rollers which, in a certain position of the table 32 itself, have the respective axes parallel to those of the feed line 29, so as to provide the necessary continuity which allows the translation of the palletised loads P.

The machine M also comprises a counter-table 33, with related support means 34, opposed to the rotating table 32 and suitable to be positioned over the top of the palletised load P so as to keep it in the correct equilibrium position during the rotation imparted by the table 32, and furthermore in such a way as to maintain the top sheet C applied to the load P from the device 1 in the suitable position.

The support 2 for the palletised load P is provided along the feed line 27.

More in detail, the support 2 consists of a determined area of the feed line 29, i.e. the most suitable area in which to deposit the top sheet C over the top of the palletised load P, and then carry out the lateral wrapping thereof in the most fast and easy way.

For example, the area of the feed line 29 at which the top sheet C is carried out may be that which immediately precedes the arrival of the load P on the rotating table 32.

The distance between this application area and the rotating table 32 can be minimized, since the robotic arm 5 can also follow the load P as it moves towards the table 32.

It has thus been seen how the invention achieves the intended purposes.

The device 1 and the machine M according to the present invention allow to obtain a greater flexibility and versatility both in terms of design and use, since the robotic arm 5 can be placed in the most suitable position in relation to the requirements of layout and overall plan dimensions, as well as the functional requirements for applying the top sheet C over the top of the palletised load P.

Moreover, replacement operations of the top film reel B or even maintenance operations thereof are considerably simplified, since the unwinding means 3 are now positioned so as to be easily accessible to the operators, and in areas provided with protections 23 from the range of the robotic arm 5.

An object of the present invention is also a process for applying top sheets C to palletised loads P.

The process comprises a step of providing a support 2 for the palletised load P.

The process further comprises a step of feeding a top sheets C to be laid down on a palletised load P.

Subsequently, the process comprises a step of wrapping the sheet C on a wrapping surface 10, so that the sheet C itself takes on a substantially tube-shaped configuration. Then, the process provides a step of taking the sheet C, wrapped on such wrapping surface 10, at the top of the palletised load P.

A step of unwinding the sheet (C) over the top of the palletised load (P), so that the sheet (C) itself moves from the substantially tube-shaped transport configuration to a stretched configuration, suitable for the following and complete wrapping of the load P, is then performed.

More in particular, the step of wrapping the sheet C on the wrapping surface 10 comprises a step of grasping the edge D of the sheet C, and a step of rotating the wrapping surface 10 for a certain number of turns, in a first rotation direction, so as to wrap and compact the sheet C itself in the above mentioned substantially tube-shaped configuration.

Likewise, the step of unwinding the sheet C over the top of the palletised load P comprises a step of rotating, in a second rotation direction opposite to the first, the wrapping surface 10 and, once the unwinding has been completed, a step of releasing the edge D of the sheet C.

In an embodiment of the invention, the aforementioned process is implemented, in particular, by the device 1 described above.

The present invention has been described according to preferred embodiments; however, equivalent variants can be conceived without departing from the protection scope offered by the following claims.

The invention claimed is:

1. A device for applying top sheets to palletised loads, comprising at least one support for at least one palletised load, feeding means for supplying top sheets to be applied to palletised loads, suitable for unwinding at least one film reel from which a plurality of said top sheets can be obtained, and at least one applicator member suitable for arranging individually each of the top sheets obtained from said at least one film reel over the top of the corresponding palletised loads, wherein said applicator member comprises at least one robotic arm, having at least one operating end, and at least a winding and unwinding member rotatably connected with said at least one operating end of the at least one robotic arm, said winding and unwinding member for wrapping said sheet, taken from said reel, on a wrapping surface, so as to take on a substantially tube-shaped configuration and then to unwind it over the top of the palletised load in a stretched configuration.

2. The device according to claim 1, wherein said winding and unwinding member comprises gripping means for gripping an edge of the film of said reel, to take from it each top sheet to be laid down over the top of said palletised load.

3. The device according to claim 2, wherein said gripping means comprise one or more pliers, each comprising a first member and a second member mutually movable between an open position and a closed gripping position of said edge.

4. The device according to claim 2, wherein said winding and unwinding member comprises a support element, and wherein said wrapping surface comprises a plurality of different and separated portions, arranged around said support element.

5. The device according to claim 4, wherein each of said portions comprises a corresponding peripheral element connected to said support element by means of a connecting element.

6. The device according to claim 5, wherein said peripheral element has a circular or substantially circular cross-section.

7. The device according to claim 5, wherein some of said connection elements are connected directly to each other so as to constrain said peripheral elements at certain positions.

8. The device according to claim 7, wherein said gripping means are connected to said peripheral elements by means of further connecting elements, comprising small arms.

9. The device according to claim 4, wherein said support element comprises a section provided with peripheral slots for the engagement of said gripping means.

10. The device according to claim 2, wherein said gripping means are of the pneumatically-driven type, and wherein said winding and unwinding member comprises a rotating pneumatic joint for feeding compressed air to said gripping means.

11. The device according to claim 2, wherein said feeding means comprise selective locking means of the edge of each top sheet (C) unwound by said reel (B), wherein the selective locking means maintain said edge (D) in a proper position so as to allow said gripping means to grasp it.

12. The device according to claim 11, wherein said selective locking means comprise at least a first element and a second element mutually movable between a free passage position of the edge of the reel wherein they are spaced from each other, and a locking position of the edge of the reel wherein they are mutually in contact so as to clamp the edge between them.

13. The device according to claim 1, wherein said robotic arm comprises a rotating joint comprising a first actuator for selectively tilting said winding and unwinding member with respect to said operating end, and a second actuator for selectively rotating said winding and unwinding member around a winding and unwinding axis.

14. The device according to claim 1, wherein said feeding means comprise at least one slot for at least one corresponding top film reel, comprising at least two unwinding rollers, with parallel axes, on which said reel can roll, said unwinding rollers being idle or at least one of them being associated with the corresponding rotating actuating means.

15. A wrapping machine of palletised loads, comprising at least one application device of top sheets according to claim 1.

16. The wrapping machine according to claim 15, comprising a feed line of the palletised loads between an inlet and an outlet, said feed line comprising said support for said palletised load, at least one wrapping device having at least one winding head, which in turn supports at least one film winding reel around the palletised loads.

17. The wrapping machine according to claim 16, comprising at least one rotating table revolving around an axis, which, in use, is vertical and being provided along said feed line between said inlet and said outlet.

18. A method for applying top sheets to palletised loads, comprising the steps of providing a support for a palletised load;

feeding a top sheet to be laid down on the palletised load;

wrapping the sheet on a wrapping surface, so that the sheet takes on a substantially tube-shaped configuration;

taking the sheet, wrapped on said wrapping surface, at the top of the palletised load;

unwinding the sheet over the top of the palletised load, so that the sheet itself moves from the substantially tube-shaped transport configuration to a stretched configuration.

19. The method according to claim 18, wherein said step of wrapping the sheet comprises a step of grasping the edge of the sheet, and a step of rotating said wrapping surface for a certain number of turns, in a first rotation direction, so as to wrap and compact the sheet itself in said substantially tube-shaped configuration.

20. The method according to claim 19, wherein said step of unwinding the sheet comprises a step of rotating, in a second rotation direction opposite to the first one, said wrapping surface, and a step of releasing said edge at the end of the unwinding.

* * * * *